United States Patent [19]

Degginger

[11] Patent Number: 4,472,495

[45] Date of Patent: Sep. 18, 1984

[54] REDUCTION OF COLOR INTENSITY OF KODACHROME COLOR FILM

[76] Inventor: Edward Degginger, 21 Bradwahl Dr., Convent Station, N.J. 07961

[21] Appl. No.: 459,457

[22] Filed: Jan. 20, 1983

[51] Int. Cl.[3] ..... G03C 7/40

[52] U.S. Cl. ..... 430/357; 430/432; 430/463

[58] Field of Search ..... 430/140, 379, 373, 370, 430/432, 461, 463, 357

[56] References Cited

U.S. PATENT DOCUMENTS 2,132,154 10/1938 Gaspar ..... 430/140
2,195,419 4/1940 McQueen et al. ..... 430/379

FOREIGN PATENT DOCUMENTS 637093 5/1950 United Kingdom .

OTHER PUBLICATIONS

Spencer, "Color Photography in Practice", 1948, 3rd Ed., pp. 216–225, 277–280.
Watkins, The Focal Guide to Colour Film Processing, 1978, pp. 160–169.

*Primary Examiner*—Mary F. Downey
*Attorney, Agent, or Firm*—Albert H. Graddis

[57] ABSTRACT

The color-intensity of exposed and developed Kodachrome color film in the form of color transparencies or continuous strip such as movie film can be reduced by treating selected areas or all of the emulsion side of said color film with an aqueous solution of a dichromate salt acidified with an inorganic mineral acid or formic acid. Any undesirable alteration in color tone is minimized by including a soluble salt of nickel or cobalt in said aqueous solution. The reduction in color-intensity is a function of time and/or acid concentration.

12 Claims, No Drawings

REDUCTION OF COLOR INTENSITY OF KODACHROME COLOR FILM

BACKGROUND OF THE INVENTION

Color film is widely employed by ameteur and professional photographers for producing movies and color slides. These slides and movies are used in projection devices and the greatly enlarged image thrown on a screen. Color slides may also be reproduced as positive color prints or may be utilized for the production of color separation plates by means of which excellent color reproduction may be obtained by utilizing the color separtion plates in well-known color printing processes.

One of the most popular color films employed is the Kodachrome color film manufactured by the Eastman Kodak Company. This film consists of a film support on which is applied a series of emulsion layers which are responsive or sensitive respectively to the red, green and blue colors in the picture being taken. On development, these colors are transformed to cyan, magneta and yellow. Light beams projected through the developed color film yield the ultimate color of the scene as photographed by the additive effect of the several developed colors as the light beam passes trough the several emulsion layers to the observer.

While the following discussion of the invention referes more particularly to the treatment of color transparency slides it is to be understood that the procedures described for the reduction in color intensity of underexposed Kodachrome color film apply equally to the treatment of underexposed continuous strip movie film. Processing of the latter requires the provision of suitable continuous processing tanks through which the continuous film may be drawn.

As in an photographic process human error or unfavorable light conditions may cause one or more areas of the color film employed to be underexposed or overexposed. Underexposure yields a color transparency exhibiting an undesirable degree of color-intensity with the result that a great deal of the detail in the picture is lost. Overexposure yields a color transparency having a thin, pale and washed-out look. The ability to modify an underexposed color transparency and restore detail to one or more areas by reducing the color intensity using a simple treatment puts a valuable tool into the hands of photographers. A technically unsatisfactory or unsaleable Kodachrome color transparency can be readily transformed into one which exhibits all of the color attributes generally recognized as desirable in the case of color transparencies.

DESCRIPTION OF THE INVENTION

It has now been found that the color-intensity of an exposed and developed Kodachrome transparency may be reduced in a uniform and controlled manner if the exposed and developed transparency is subjected to the action of an aqueous solution of a dichromate salt containing an amount of an inorganic mineral acid or formic acid sufficient to acidify said dichromate solution. It has also been found that the uniformity with which said color reduction takes place with minimal alteration in the color tone of the several colors making up the emulsion layer is greatly enhanced if a nickel or cobalt salt is also present in said aqueous solution.

Any readily water-soluble salt containing the dichromate radical $Cr_2O_7$= may be employed such as $Na_2Cr_2O_7$, $K_2Cr_2O_7$ or $(NH_4)_2Cr_2O_7$. Preferably, the aqueous solution will contain from about 1 to 4% by weight of the dichromate salt employed. Any of the commonly available mineral acids such as hydrochloric, nitric or sulfuric acid are suitable for use in acidifying the aqueous dichromate solution. Phosphoric and formic acid can be employed but are somewhat less effective. A convenient method of controlling the speed at which the reduction in color intensity takes place is to employ more or less mineral acid. Thus, for example, from 1 to 20 drops of concentrated mineral acid may be added to each 50 ml. volume of aqueous dichromate solution employed. The use of a greater amount of acid makes the reduction in color intensity less controllable and is not recommended.

The temperature at which the acidified aqueous dichromate solution is maintained during the color-intensity reduction procedure is not critical and ordinarily encountered room temperatures are quite satisfactory when carrying out the procedure. Control of the speed of reaction is easily achieved at temperatures of 15° to 20° C. bearing in mind the effect of acid concentration as mentioned above.

However, it has also been found that the desired reduction in color-intensity may be attained, as described, without any shift in the original color tones if a small amount of a water-soluble salt of nickel or cobalt is also present in the acidified dichromate solution during the color-intensity reduction. The salts may be in the hydrous or anhydrous form. Suitable nickel salts which may be employed are, for example, nickel sulfate, nickel chloride, nickel acetate, etc., or the corresponding soluble cobalt salts. Only relatively small amounts of said nickel or cobalt salts are needed to obtain the desired effect. Generally, employing said nickel salts in an amount up to about 1.0% by weight of the amount of dichromate employed is quite satisfactory.

The degree to which the reduction in color-intensity is achieved is a function of time with any given acid concentration. The longer the color transparency is immersed in the acidified dichromate solution the more pronounced the degree of reduction in color intensity. Thus, immersion of all or any particular part of the color transparency in the aqueous dichromate solution for from about 10 seconds to about 3 minutes or more is satisfactory depending on the acid concentration. Observation of the color reduction will dictate when the reaction should be halted. For example, employing a solution of 2.5% by weight of potassium dichromate containing 0.018% $NiSO_4.6H_2O$ and 10 drops of concentrated HNO3 excellent results are obtained with a treatment of from 10-40 seconds.

Vigorous washing with several changes of water will remove the acidified dichromate solution from the color transparency and halt the reaction. Immediate cessation of the reaction is achieved without delay by immersing the treated color transparency in an aqueous solution of a reducing agent such as sodium bisulfite. This reduces the dichromate present to the trivalent chromic ion and also neutralizes any excess acid. The concentration of the aqueous sodium bisulfite employed is not critical and only an excess over the stoichiometric amount required to react with the dichromate and to neutralize the acid is needed. Accordingly, a 1% aqueous solution of sodium bisulfite has been found to be satisfactory. A clear water rinse after immersion in the reducing agent followed by treatment with an alkaline neutralizing agent such as, for example, ammonium hydroxide to remove any remaining acid is advantageous. This step is followed by several clear water rinses to remove the last traces of any soluble salt residue. The treated color transparencies are then dried with the emulsion side up after any surface water is squeegeed off. If there are any remaining water spots the color transparency may then be polished to remove them with moist lens tissue.

The color-intensity reduction treatment described may be applied to the entire surface of the color transparency by immersion or selected areas may be treated by merely applying the solutions to those areas with a fine brush. Treated transparencies may be retreated repeatedly until the desired degree of color reduction is achieved.

Careful observation and control are essential since overtreatment with any dichromate solution with or without a nickel or cobalt salt will produce undesirable and unnatural purple colorations.

In order further to illustrate this invention the following examples are given:

EXAMPLE 1

An aqueous solution of potassium dichromate ($K_2Cr_2O_7$) is prepared by dissolving 1.2 gm of the potassium dichromate in 50 ml of water at about 20° C. and then 5 drops of concentrated HCL are carefully added with agitation. A relatively dense Kodachrome color transparency having definitely underexposed foreground areas, among others, is fully immersed in this solution for 60 seconds to reduce the color-intensity of these underexposed areas. The transparency is then immersed in a 1% aqueous solution of sodium bisulfite to stop further reduction and neutralize the acid present. After several water washes in clear water the transparency is then immersed in a 1% aqueous solution of ammonium hydroxide (suitably diluted household ammonia is satisfactory) to neutralize any remaining acid and is washed again in clear water and then squeegeed, dried and polished. Examination of the treated Kodachrome color transparency shows that a great deal of the foreground detail initially lost because of underexposure is now apparent and is clearly evident on examination using a light box and especially when the treated transparency is projected onto a screen. The resulting color is slightly warmer than the original color.

EXAMPLE 2

A color transparency color-intensity reduction solution of potassium dichromate acidified with nitric acid and containing a soluble nickel salt is prepared by dissolving 1.2 gm of $K_2Cr_2O_7$ in 50 ml of water at room temperature, followed by 0.01 gm of $NiSO_4.6H_2O$ and then acidifying with 10 drops of conc. $HNO_3$. Using this solution and immersing underexposed Kodachrome color transparencies in this solution for a color-intensity reduction treatment time of 10 to 40 seconds followed by sodium bisulfite reduction, water wash and acid neutralization, as described, yields excellent results in reducing the color-intensity of the transparency without any noticeable color shift away from the original colors present.

EXAMPLE 3

An underexposed Kodachrome color transparency having relatively color dense areas is subjected to a color-intensity reduction treatment similar to that described in Example 1 above but in addition to the potassium dichromate present in the initial aqueous treatment solution there is also added 0.01 gm of nickel sulfate hexahydrate. The immersion time as well as the subsequent sodium bisulfite treatment, ammonium hydroxide neutralization and intermediate water washes are the same. After drying and polishing, examination of the color transparency shows excellent restoration of recognizable detail in the previously dark and color-dense areas without any noticeable shift in color tone in any areas of the color transparency.

Local treatment with the above agent of selected areas of color-dense Kodachrome color transparencies where excessive color intensity is due to underexposure yields the same desirable increase in detail without any color shift.

EXAMPLE 4

The procedure described in Example 2 is repeated step for step with the exception that the amount of $NiSO_4.6H_2O$ added to the potassium dichromate solution is increased to 0.1 gm. This ten-fold increase in the nickel salt concentration acts to produce a slightly cooler color in those underexposed Kodachrome color transparencies treated with this color-intensity reduction both by producing a faintly bluish shift in the colors present.

The foregoing color-intensity reduction treatment is especially effective in connection with the treatment of that Kodachrome color transparency film currently available.

I claim:

1. Process for the reduction of the color density of exposed and developed Kodachrome color film, which comprises treating said exposed and developed color film with an aqueous solution of a dichromate salt containing an inorganic mineral acid or formic acid in an amount sufficient to acidify said dichromate solution and maintaining said color film in said solution for a time sufficient to effect the desired reduction in color density.

2. Process in accordance with claim 1 wherein said aqueous dichromate solution is an aqueous solution of sodium dichromate, potassium dichromate or ammonium dichromate.

3. Process in accordance with claim 2 wherein said acid is hydrochloric acid, nitric acid, sulfuric acid, phosphoric acid or formic acid.

4. Process in accordance with claim 1 wherein the color reduced transparency is then treated to halt the action of the acidified dichromate salt solution.

5. Process in accordance with claim 4 wherein the color reduced transparency is treated with an aqueous solution of a bisulfite.

6. Process for the reduction of the color density of exposed and developed Kodachrome color film in the form of a finished color transparency, which comprises treating said exposed and developed transparency with an aqueous solution of a dichromate salt containing an inorganic mineral acid or formic acid in an amount sufficient to acidify said dichromate solution and also containing a water-soluble salt of nickel or cobalt, and maintaining said color transparency in said solution for a time sufficient to effect the desired reduction in color density.

7. Process in accordance with claim 6 wherein said aqueous dichromate solution is an aqueous solution of sodium dichromate, potassium dichromate or ammonium dichromate.

8. Process in accordance with claim 7 wherein said acid is hydrochloric acid, nitric acid, sulfuric acid, phosphoric acid or formic acid.

9. Process in accordance with claim 8 wherein the color reduced transparency is then treated to halt the action of the acidified dichromate salt solution.

10. Process in accordance with claim 8 wherein the color reduced transparency is treated with an aqueous solution of a bisulfite.

11. Process in accordance with claim 8 wherein the color reduced transparency is treated with an aqueous solution of a sulfite.

12. Process in accordance with claim 1 wherein the color reduced transparency is washed with an aqueous solution of a sulfite.

* * * * *